United States Patent [19]

Peterson et al.

[11] 3,936,786

[45] Feb. 3, 1976

[54] TEMPERATURE SENSITIVE TIPSWITCH

[75] Inventors: James A. Peterson; Donald A. Mc Cabe, both of Morris, Ill.

[73] Assignee: Bimet Corporation, Morris, Ill.

[22] Filed: Feb. 13, 1975

[21] Appl. No.: 549,674

[52] U.S. Cl. ..... 337/80; 337/3;331

[51] Int. Cl.[2] ..... H01H 29/00

[58] Field of Search ..... 200/220, 221, 222, 32, 200/61.47, 81.6, 152; 337/2, 3, 21, 13, 16, 80, 331

[56] References Cited

UNITED STATES PATENTS

| | | | |
|---|---|---|---|
| 3,201,548 | 8/1965 | Mertler | 337/355 |
| 3,451,029 | 6/1969 | Levinn et al. | 337/349 |
| 3,452,312 | 6/1969 | Bauer | 337/349 X |
| 3,711,668 | 1/1973 | Harnden | 200/222 X |
| 3,758,030 | 9/1973 | Osheroff | 337/3 X |

*Primary Examiner*—J. D. Miller
*Assistant Examiner*—Fred E. Bell
*Attorney, Agent, or Firm*—Kinzer, Plyer, Dorn & McEachran

[57] ABSTRACT

A temperature-sensitive tipswitch includes a pair of normally closed flexible conductive arms. A temperature responsive actuating arm is mounted adjacent the conductive arms and insulation discs separate all three. A bracket is connected into the stack formed by the arms and insulation discs and the bracket mounts a mercury tipswitch. There are one or more terminals extending out from the stack and in electrical contact with one of the conductive arms and a second terminal connected to the tipswitch.

9 Claims, 4 Drawing Figures fig.1.
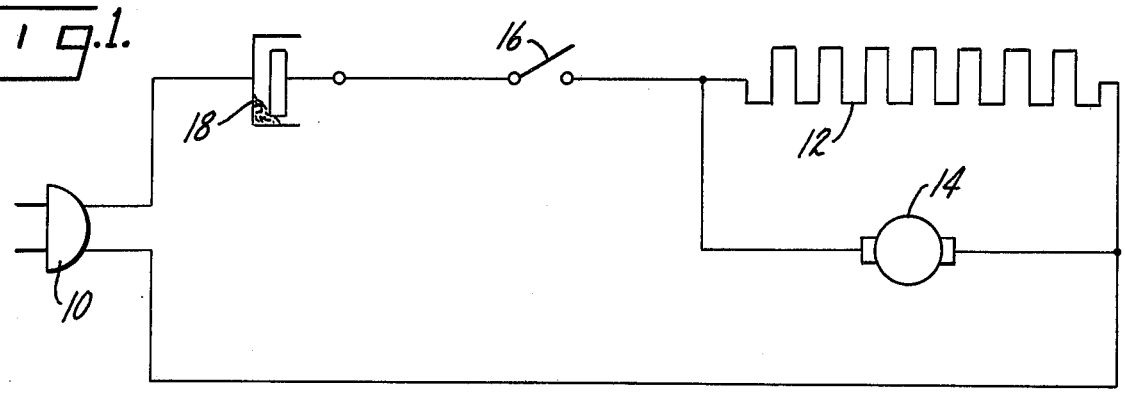
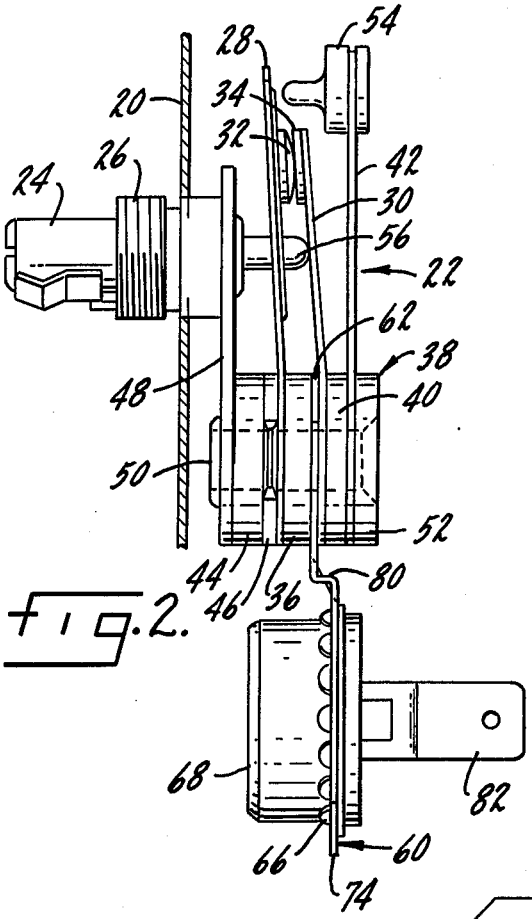
fig.2.
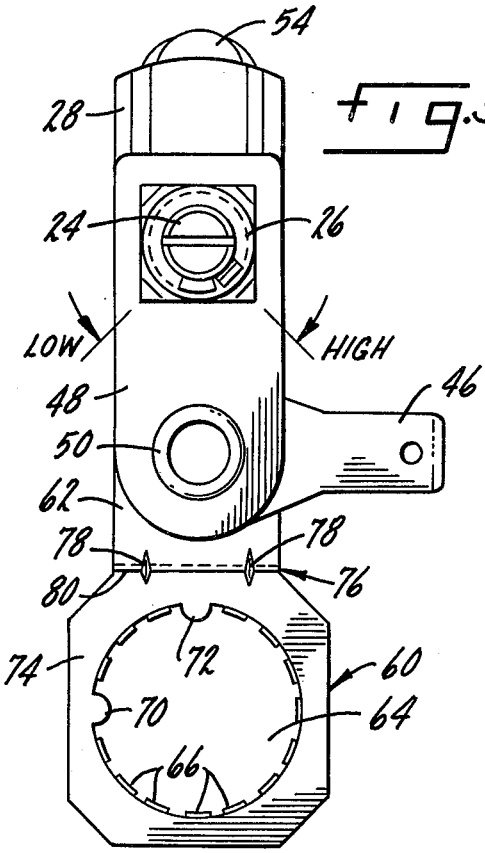
fig.3.
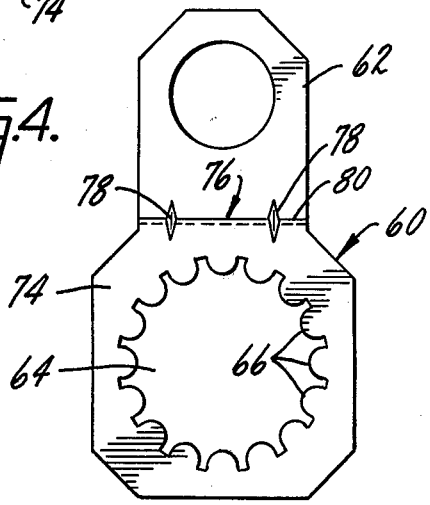
fig.4.

TEMPERATURE SENSITIVE TIPSWITCH

SUMMARY OF THE INVENTION

The present invention relates to a temperature responsive tipswitch and particularly to such a switch utilizing a mercury button switch.

One purpose of the invention is a switch of the type described providing temperature responsive and multi-axis gravity responsive circuit interruption.

Another purpose is a switch of the type described in which the temperature responsive and gravity responsive portions of the switch are independent.

Another purpose is a switch of the type described which provides low tooling cost, flexible mounting, varied terminations, simple installation and minimum cost.

Another purpose is a combination temperature responsive and gravity responsive switch utilizing a novel bracket, mounted in the stack of the temperature responsive portion of the switch and itself mounting a mercury button switch.

Another purpose is a switch of the type described in which the bracket provides locating means for properly mounting the gravity responsive portion of the switch.

Another purpose is a tipswitch of the type described in which the bracket mounting the gravity responsive portion of the switch is incorporated into the mounting stack in lieu of a terminal, thereby providing a current path to one of the thermally actuated contact members.

Another purpose is a switch of the type described using a bracket which provides a secure mechanical connection and an efficient electrical connection between the thermally responsive and gravity responsive portions of the switch.

Other purposes will appear in the ensuing specification, drawings and claims.

BRIEF DESCRIPTION OF THE DRAWINGS

The invention is illustrated diagrammatically in the following drawings wherein:

FIG. 1 is a schematic electrical diagram illustrating the functions of the switch disclosed herein, FIG. 2 is a side view of the temperature-sensitive tipswitch, FIG. 3 is a top plan view of the switch of FIG. 2, with the mercury switch removed, and FIG. 4 is a bottom view of the bracket.

DESCRIPTION OF THE PREFERRED EMBODIMENT

In the past there have been a number of different devices which provided both temperature responsive and multi-axis gravity responsive circuit interruption. The least cost designs which provided such functions have the bimetal thermal actuator and/or the pendulum moving a common contact arm, thus saving a pair of contacts. Pending Underwriters Laboratories' requirements for space heating appliances will require independent contact pairs or other protective measures if the temperature control should fail. Thus, in many applications, no longer can the bimetal thermal actuator and the pendulum move a common contact arm. This latter construction is of the general type shown in U.S. Pat. No. 3,452,312.

The present invention integrates a conductive liquid button switch, for example a mercury or sodium potassium alloy switch, through the construction of a novel bracket, into the stack of the conventional open frame thermostat. The particular button chosen is conventional and is designed and used in electric wall switches. It is intended to be rotated through a 90° arc about its axis to effect make or break circuit operation.

The switch disclosed herein is conventionally used in an appliance, for example a space heater, in which it is necessary to have circuit interruption of power to the heating element when the temperature exceeds a predetermined level or when the appliance itself is in an abnormal or tipped-over position. The invention, however, should not be limited to this particular application, as it has wider use.

In FIG. 1 a voltage source is indicated diagrammatically at 10 and a heating element is indicated at 12. A fan blower 14 may be in parallel with the heating element 12. A switch 16 diagrammatically represents the temperature responsive portion of the switch described herein, whereas, the tipswitch portion of the overall device is indicated at 18. Thus, circuit interruption may be provided either by opening switch 16 or switch 18. When both switches are closed, as in normal operation, power will be supplied both to the heating element 12 and to the fan blower 14.

In FIG. 2 a portion of the appliance mounting panel is indicated at 20. The switch indicated generally at 22 may have a control shaft 24 passing through an opening in panel 20. The shaft 24 may be internally threaded into a bushing 26 having external threads for use in mounting a nut, not shown, which will attach the overall switch construction to the panel 20. The switch may be mounted to the panel in a variety of different positions. The particular orientation of the mounting will determine the particular orientation of the mercury button switch within the overall combination. The switch may be mounted vertically, horizontally, or at any intermediate angle, depending upon the appliance, and the particular mounting of the switch will in turn determine the orientation of the mercury tipswitch. Only one particular orientation is shown herein, but it should be understood that variations on this orientation will be necessitated by the appliance and the location of the switch on the appliance.

A pair of flexible conductive arms are indicated at 28 and 30. The arms 28 and 30 each have conventional contacts, 32 and 34 respectively, which are in the normally closed position of FIG. 2. An insulating disc 36 separates the ends of arms 28 and 30 opposite contacts 32 and 34. The insulation disc 36 is a part of a stack indicated generally at 38, which also includes an insulation disc 40 separating arm 30 and a temperature responsive actuating arm 42. A disc 44 separates terminal 46, which lies flat upon arm 28 and a mounting plate 48 which is attached to the bushing 26. A rivet 50 may hold the stack 38 together and extends from the mounting plate 48 to disc or head 52 which is positioned at the opposite end of the stack.

The temperature responsive actuating arm 42 may carry a button 54 adjacent one end and in position to contact arm 28. Thus, in the conventional operation of the temperature responsive portion of the switch, when there is excessive heat in the area adjacent the switch, button 54 will move toward arm 28 and move it away from arm 30 to break the electrical connection between contacts 32 and 34.

A stop 56 extends outwardly from shaft 24 and the stop is controlled by rotation of the shaft. Note particularly FIG. 3 in which the low and high heat positions of the shaft are diagrammatically illustrated.

A bracket 60 has a mounting portion 62 which is positioned flush with contact arm 30 and between the contact arm and insulation disc 36. The bracket 60 extends outwardly from the stack and has an opening 64, shown particularly in FIG. 3. Circumferentially spaced about opening 64 are a plurality of tabs 66, all but two of which are at least partially bent over so as to permit the positioning of mercury button switch 68 within opening 64. As shown in FIG. 3, there are two tabs, 70 and 72, which are not bent to a position approximating the axis of the opening and these tabs or projections are used for positioning the mercury switch 68 within the opening. The conventional mercury button switch, as it is manufactured, has a pair of axially extending peripheral grooves. The projections 70 and 72 will fit within these grooves to thus position and properly orient the mercury button switch within the overall combination. In this connection, the number of tabs will vary in accordance with the desired accuracy of orientation. With fourteen equispaced tabs, and only one tab for orientation, the mercury switch can be rotated in approximately twelve degree increments. With sixteen tabs and one for orientation, twenty-two and one-half degree increments are available.

The bracket 60, as indicated above, has a portion 62 which is positioned within the stack. It has a portion 74 which surrounds the opening 64. Joining the portions 62 and 74 is a strengthening area 76 which includes a pair of spaced ribs 78 and a portion 80 at right angles to the portions 62 and 74. Thus, the area 76 is strengthened both by the ribs and the offset 80 between areas 62 and 74.

The button switch 68 has a terminal 82 which provides the input connection for the switch. This may be the terminal that is connected to the source 10. The bracket 60 provides the output terminal for the button switch 68 and, as shown in FIG. 1, provides the input terminal for switch 16. In the detailed illustration of FIGS. 2, 3 and 4, bracket 60 is in electrical and mechanical contact with arm 30, thus eliminating one terminal. The output from switch 16 is through arm 28 which lies flush against output terminal 46, which would be connected to the load 12 and fan 14.

In use the mercury button switch will be oriented so that there is contact between the input and output terminals through the mercury within the switch. Thus, switch 18 in the schematic of FIG. 1 will be in normally closed position. Switch 16 will also be in a normally closed position which is the position of FIG. 2. If there is excessive heat in the appliance, arm 42, because it is temperature responsive and of bimetal construction, will be slowly bent toward arm 28 such that button 54 ultimately will move arm 28 away from arm 30 to break the connection between contacts 32 and 34. This is the temperature responsive protection portion of the switch.

The mercury button switch 18 is oriented in a particular manner on the appliance so that if the appliance is tipped forward, backward, or to either side, which movement could be a potential hazard, then the mercury connection within the switch is broken and thus power to the appliance is cut off. This is the gravity responsive portion for the switch.

Of particular importance is the bracket 60. It permits a unique combination of a tipover switch and a temperature responsive switch with a minimum of additional elements. The bracket is positioned against one of the contact arms and thus provides a direct connection between the tipover switch and the temperature responsive switch. The bracket is strengthened and has an opening which provides for a particular orientation of the tipover switch. The tabs 66 serve to assure mechanical and electrical integrity and effectively provide an interference fit between the bracket and the tipover switch. The number of tabs may vary, depending upon the degree of accuracy required in the orientation of the tipover switch.

The button switch 68 has a terminal 82 which provides the input connection for the switch. Alternate input connections could be wire or other terminal types crimped, welded or soldered in place.

Whereas the preferred form of the invention has been shown and described herein, it should be realized that there may be many modifications, substitutions and alterations thereto.

The embodiments of the invention in which an exclusive property or privilege is claimed are defined as follows:

1. A temperature sensitive and gravity sensitive switch including a pair of flexible conductive arms arranged for contact adjacent one end thereof, insulation means mounting and separating the opposite ends of said arms, a temperature responsive actuating arm and insulating means mounting and separating one end thereof from said conductive arms, means on said actuating arm positioned for contact with one of said conductive arms to effect opening and closing of said conductive arms, a bracket in electrical contact with a conductive arm and mounted thereto by said insulation means, and a conductive liquid tipswitch mounted in said bracket and connected in series with said conductive arm through said bracket.

2. The structure of claim 1 further characterized in that said bracket includes an opening, locating means in said opening for positioning said conductive liquid tipswitch within said opening.

3. The structure of claim 2 further characterized in that said conductive liquid tipswitch has a generally cylindrical outer housing, at least one axially extending groove in the outer surface of said housing, said locating means including a projection integral with said bracket and extending into said opening.

4. The structure of claim 3 further characterized by and including a pair of circumferentially-extending spaced projections extending into said opening for locating said conductive liquid tipswitch therewithin.

5. The structure of claim 1 further characterized in that said insulation means include a plurality of separate discs, there being one disc between said flexible conductive arms and a second disc between one of said arms and said temperature responsive actuating arm.

6. The structure of claim 5 further characterized in that said bracket has a portion thereof lying flat upon a portion of a conductive arm.

7. The structure of claim 6 further characterized in that said insulation discs, bracket, temperature responsive actuating arm and flexible conductive arms are all secured together in a single stack.

8. The structure of claim 7 further characterized by and including strengthening means formed in said bracket between said tipswitch and the portion of the bracket lying flat against a conductive arm.

9. The structure of claim 1 further characterized by and including a terminal connected to one of said conductive arms and a second terminal connected to said conductive liquid tipswitch, said bracket being in electrical contact with the other of said conductive arms.

* * * * *